US007115854B1

(12) United States Patent
Kato et al.

(10) Patent No.: US 7,115,854 B1
(45) Date of Patent: Oct. 3, 2006

(54) PHOTOMULTIPLIER AND PHOTODETECTOR INCLUDING THE SAME

(75) Inventors: Hisaki Kato, Hamamatsu (JP); Hideki Shimoi, Hamamatsu (JP); Kazuya Horiuchi, Hamamatsu (JP); Toshiaki Ushizu, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 11/188,215

(22) Filed: Jul. 25, 2005

(51) Int. Cl.
*H01J 40/14* (2006.01)
*H01J 43/00* (2006.01)

(52) U.S. Cl. ..... 250/214 VT; 250/207; 313/533; 313/103 R

(58) Field of Classification Search ..... 250/214 VT, 250/207; 313/532–533, 103 R, 103 CM, 313/105 R, 105 CM
See application file for complete search history.

(56) References Cited

U.S. PATENT DOCUMENTS 5,077,504 A 12/1991 Helvy
6,472,664 B1 * 10/2002 Kyushima et al. ..... 250/366
6,617,768 B1 * 9/2003 Hansen ..... 313/103 CM

FOREIGN PATENT DOCUMENTS

JP 7-335174 12/1995
WO 03/004982 A1 1/2003

* cited by examiner

*Primary Examiner*—Kevin Pyo
(74) *Attorney, Agent, or Firm*—Drinker Biddle & Reath LLP

(57) ABSTRACT

The present invention relates to a photomultiplier that can realize a gain adjustment for each of electron multiplier channels respectively assigned to a plurality of light incidence regions in a more compact structure. The photomultiplier has a sealed container, and a photocathode, a dynode unit, and plurality of anodes prepared for electron multiplier channels are housed in the sealed container. The dynode unit is constituted by N (an integer or no less than 3) dynode plates, each provided with an electron multiplier hole for the associated channel, concerning all channels. In particular, the n-th (an integer of no less then 2) dynode plate is constituted by a plurality of control plates, each having an electron multiplier hole for the associated channel, and electrically and physically separated from the others. These control plates are supported in state of being supported, via insulators, by the (n−1)-th dynode plate and the (n+1)-th dynode plate.

10 Claims, 9 Drawing Sheets

I
I
210
200
220
230
240
220a
310b
320
300
310a
330
340
110
100
120
130

PHOTOMULTIPLIER AND PHOTODETECTOR INCLUDING THE SAME

BACKGROUND OF THE INVENTION

1. Field of the Invention

The present invention relates to a photomultiplier which enables an electron multiplication for each of electron multiplier channels respectively assigned to a plurality of light incidence regions partitioned on an entrance face plate, and a photodetector including the same.

2. Related Background of the Invention

U.S. Pat. No. 5,077,504 discloses a photomultiplier having a single entrance face plate partitioned into a plurality of light incidence regions, and having a structure in which a plurality of electron multiplier sections (each constituted by an anode and a dynode unit comprising a plurality of dynode stages) prepared as processing channels (electron multiplier channels) assigned to the plurality of light incidence regions (having a photocathode formed on the inner surface), are sealed inside a single glass tube. A photomultiplier, having such a structure that a plurality of processing channels are contained within a single glass tube, is generally referred to as a "multi-anode photomultiplier," and as outputs of the respective channels, electrical signals are taken out from the anodes corresponding to the respective channels.

SUMMARY OF THE INVENTION

The inventors have studied conventional multi-anode photomultiplier in detail, and as a result, have found problems as follows.

Namely, the multi-anode photomultiplier disclosed in U.S. Pat. No. 5,077,504 has a structure such that a plurality of electron multiplier sections, physically and electrically separated from each other, are housed in a single glass tube. That is, a limit to making the photomultiplier itself compact and the resolution of a photodetector could not be improved.

On the other hand, the making of the photomultiplier itself compact by arranging the dynodes of each stage of the plurality of electron multiplier sections as a common dynode (on which electron multiplier holes are respectively provide for electron multiplier channels) may be considered. However, since the electron multiplier holes for channels in each dynode are provided with a common potential, the gain cannot be adjusted in each channel. Applications are thereby restricted significantly.

Also, in consideration of applications of the multi-anode photomultiplier to high energy physics and other scientific technological fields (digital signal processing applications) as well as fluorescence analysis, blood analysis, drug development, and other analysis technologies in the field of biotechnology (analog signal processing applications), it is inadequate to simply make the gain uniformity substantially uniform among the respective channels to adjust the detection efficiency of the respective channels. A multi-anode photomultiplier, in which the gain of each channel can be controlled by two digits or more while each channel is set at an arbitrary gain, is necessary.

The present invention has been made to resolve the above problems and an object thereof is to provide a photomultiplier which can realize a gain adjustment for each of electron multiplier channels respectively assigned to a plurality of light incidence regions partitioned on an entrance face plate in a more compact structure, and a photodetector including the same.

A photomultiplier according to the present invention relates to a multi-anode photomultiplier having a plurality of electron multiplier sections respectively prepared for electron multiplier channels assigned to a plurality of light incidence regions partitioned on an entrance face plate, and the photomultiplier has a sealed container having the entrance face plate partitioned into the plurality of light incidence regions, and a stem opposing the entrance face plate. Inside the sealed container of the photomultiplier, a photocathode emitting photoelectrons into the sealed container in response to light having passed through the entrance face plate, a plurality of anodes respectively prepared for the electron multiplier channels assigned to the plurality of light incidence regions partitioned on the entrance face plate and arranged at positions corresponding to the plurality of light incidence regions, and a dynode unit provided between the plurality of anodes and the photocathode are housed. Here, the dynode unit is constituted by N (an integer of no less than 3) dynode plates, and in each dynode plate, one or more electron multiplier holes for the associated channel are positioned, concerning all channels, at positions corresponding to the associated one of the light incidence regions. One electron multiplier section that makes up a single electron multiplier channel is constituted by the electron multiplier holes for the associated channel that are provided in each dynode plate and the anode for the associated channel.

In particular, the n-th (an integer of no less than 2) dynode plate in the dynode unit is constituted by a plurality of control plates each having one or more electron multiplier holes for the associated channel and being electrically and physically separated from the others. These control plates are supported in a state of being sandwiched, via insulators, by the (n−1)-th dynode plate and the (n+1)-th dynode plate. By this arrangement, each of the control plates making up the n-th dynode plate can be set to an arbitrary potential, thereby enabling realization of a gain adjustment for each channel in a more compact structure.

The photomultiplier according to the present invention may further comprise a protection electrode provided between the stem and the dynode unit. This protection electrode supports the entirety of the dynode unit via an insulator and is provided with a plurality of through holes each housing the associated one of the anodes individually. In particular, a diameter of each dynode side opening of the protection electrode is preferably narrower than a diameter of each stem side opening of the protection electrode. In this case, since the trajectories of secondary electrons emitted from the final stage of dynode plate in the dynode unit to the anodes are respectively converged every anode, crosstalk among the anodes corresponding to the respective channels is reduced effectively.

In the photomultiplier according to the present invention, each of the control plates constituting the n-th dynode plate is preferably supported by at least three insulators disposed between the n-th dynode plate and the (n+1)-th dynode plate, and by one lead pin that extends into the sealed container via the stem. Extraneous structures can thus be eliminated, and therefore the entire photomultiplier can be made even more compact. Among the dynode plates constituting the dynode unit, each of at least the dynode plates positioned between the n-th dynode plate and the plurality of anodes has, at outer peripheral portions thereof, a plurality of notched portions each provided in correspondence to the associated one of the lead pins respectively connected to the plurality of control plates constituting the n-th dynode plate, and having a curved surface so as to be separated from the associated lead pin by a predetermined distance. When the photomultiplier is made compact, the distances among metal members become close inevitably and the possibility of the occurrence of discharge at the edge portions of the metal members becomes high. Thus in the case where the distances among metal members become close, the generation of discharge is preferably restrained by intentionally processing the metal members to shapes with curved surfaces.

The photomultiplier according to the present invention may further comprise a focusing electrode disposed between the photocathode and the dynode unit. In this case, the focusing electrode is preferably provided with a plurality of through holes each arranged at a position corresponding to the associated one of the channels assigned to the plurality of light incidence regions partitioned on the entrance face plate. Since photoelectrons emitted from a certain region of the entrance face plate will then arrive at a high probability at an electron multiplier hole, which, among the electron multiplier holes of the first dynode plate, corresponds to the channel assigned to the region from which the photoelectrons are emitted, crosstalk among the electron multiplier channels is reduced effectively.

A photodetector according to the present invention has the photomultiplier with the above-described structure (the photomultiplier according to the present invention) and a bleeder circuit unit. The bleeder circuit unit sets at least the respective dynode plates of the dynode unit in the photomultiplier to predetermined potentials. The bleeder circuit has an adjusting mechanism for setting each of the plurality of control plates, constituting the n-th dynode plate of the N dynode plates in the dynode unit, individually to an arbitrary potential. This arrangement enables each of the control plates constituting the n-th dynode to be set to an arbitrary potential and thus the realization of gain adjustment for each channel in a more compact structure.

The photodetector according to the present invention may further comprises a case housing the photomultiplier and the bleeder circuit unit while at least part of the entrance face plate of the photomultiplier is exposed. In this case, the case preferably has an opening for adjusting, from the exterior of the case, the adjusting mechanism provided in the bleeder circuit unit.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, embodiments of a photomultiplier and a photodetector including the same according to the present invention will be explained in detail with reference to FIGS. 1–4, 5A–5B, 6–7 and 8A–9B. In the explanation of the drawings, constituents identical to each other will be referred to with numerals identical to each other without repeating their overlapping descriptions.

Figure 1:
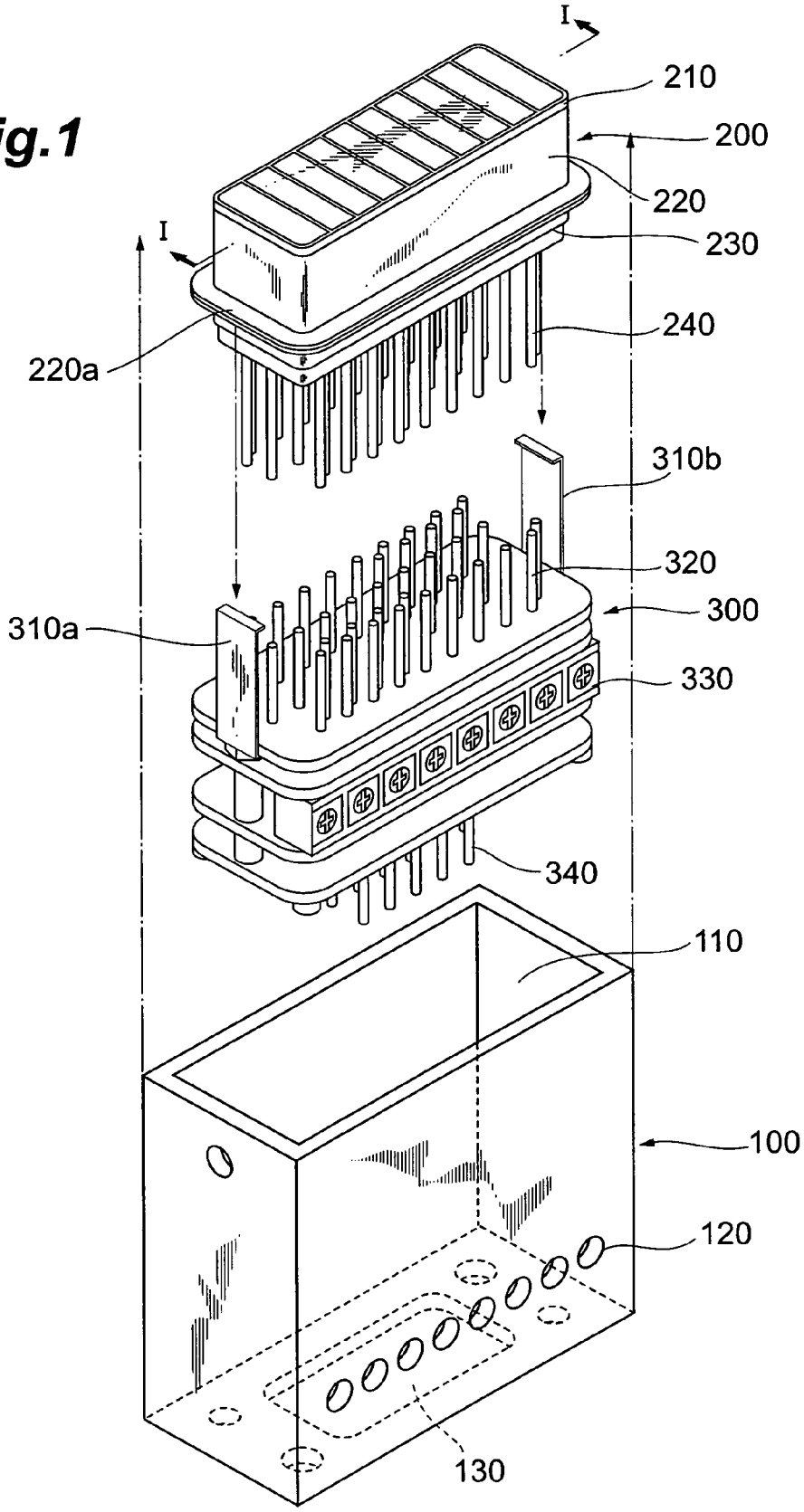
FIG. 1 shows an assembly process diagram of a configuration of a photodetector (photodetector according to the present invention) including a photomultiplier according to the present invention.
Figure 2:
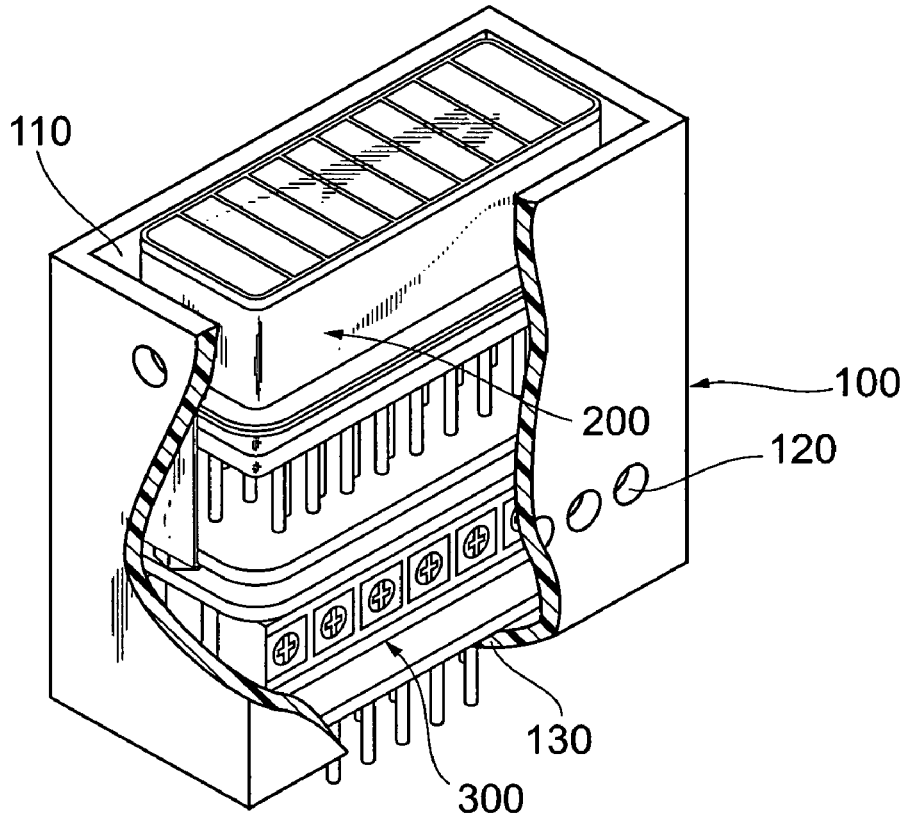
FIG. 2 shows a partially broken-away view of the configuration of the photodetector (photodetector according to the present invention) including the photomultiplier according to the present invention.

FIG. 1 shows an assembly process diagram of a configuration of a photodetector (photodetector according to the present invention) including a photomultiplier according to the present invention, and FIG. 2 shows a partially broken-away view of a configuration the photodetector (photodetector according to the present invention) including the photomultiplier according to the present invention. In the following embodiment, an 8-channel multi-anode type of photomultiplier, in which an entrance face plate is partitioned into eight effective regions, will be explained.

As shown in FIG. 1, the photodetector according to the present invention comprises a case 100, a photomultiplier 200, and a bleeder circuit unit 300. The photomultiplier 200 comprises an entrance face plate 210 which is partitioned into a plurality of light incidence regions each corresponding to a signal channel, a stem 230 which holds a plurality of lead pins 240, and a metal container 220 provided with a flange 220*a* and housing an electron multiplier section in the interior. The bleeder circuit unit 300 has pipe-like metal sockets 320 (see FIG. 6) respectively housing lead pins 240 that extend to the exterior from the stem 230 of the photomultiplier 200, output terminals 340 for taking out electrical signals from each of the plurality of anodes housed inside metal container 220, fixing members 310*a* and 310*b* which engage with the flange 220 of the metal containers 220 in the state that the lead pins 240 of the photomultiplier 200 are housed in metal sockets 320, and adjusters 330 for adjusting variable resistors that constitute a part of the bleeder circuit. The case 100 houses both the photomultiplier 200 and the bleeder circuit unit 300, and has an upper opening 110 which exposes at least part of the entrance face plate 210 in the state of housing the photomultiplier 200, a lower opening 130 which leads output terminals 340 of the bleeder circuit unit 300 out to the exterior of the case 100, and openings 120 which enable the adjustment of each adjuster 330 from the exterior of the case 100.

The state in which the photomultiplier 200 and the bleeder circuit unit 300 are housed in the case 100 from the upper opening 110 is shown in FIG. 2.

Figure 3:
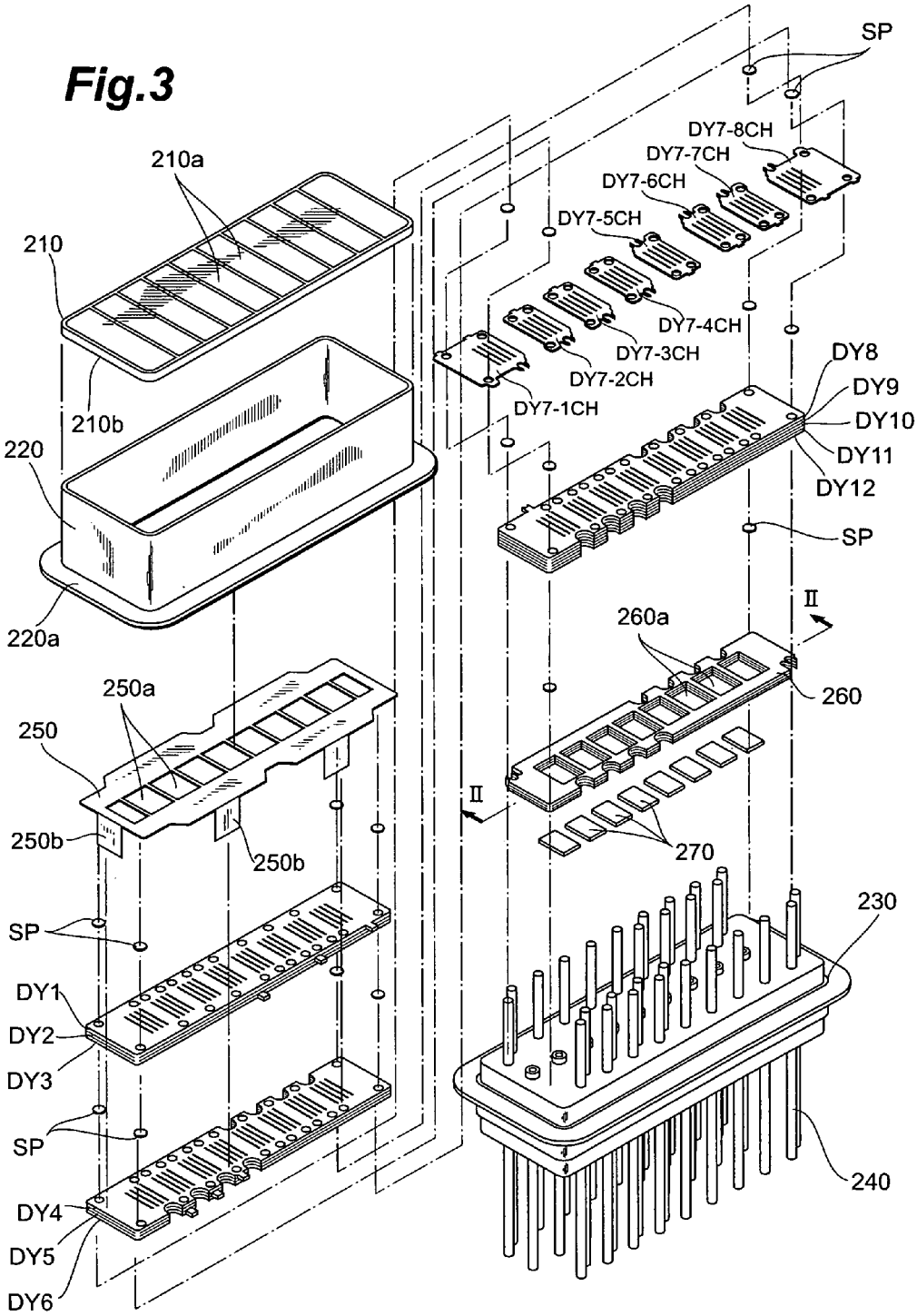
FIG. 3 shows an assembly process diagram of a configuration of a photomultiplier according to the present invention.

The structure of the photomultiplier 200 (the photomultiplier according to the present invention), shown in FIGS. 1 and 2, will now be explained by using FIGS. 3 and 4. FIG. 3 shows an assembly process diagram of the arrangement of the photomultiplier 200.

As shown in FIG. 3, in the photomultiplier 200, a sealed container comprises the entrance face plate 210 which is partitioned into a plurality of light incidence regions 210*a* respectively assigned to signal processing channels, the metal container 220 having a flange 220*a*, and the stem 230 holding the plurality of lead pins 240.

Inside the sealed container, a photocathode 210*b*, a focusing electrode 250, a dynode unit, and anodes 270 are arranged in the order towards the stem 230 from the side of the entrance face plate 210.

The photocathode 210*b* is formed on a surface of the entrance face plate 210 at the side positioned inside the sealed container.

The focusing electrode 250 has openings 250*a* which are provided at positions corresponding to light incidence regions 210*a* so as to correspond to the respective channels, and spring electrodes 250*b* which contact the inner wall of the metal container 220 such that the potential of the focusing electrode 250 is set equal to the potential of the metal container 220. The focusing electrode 250 is fixed to the dynode unit via the ceramic spacers SP made of an insulator.

In the embodiment shown in FIG. 3, the dynode unit is constituted by twelve dynode plates DY1 to DY12. The respective dynode plates DY1 to DY12 are laminated via the ceramic spacers SP. In particular, the seventh dynode plate is constituted by control plates DY7-1CH to DY7-8CH, which are electrically and physically separated from each other. In each of the control plates DY7-1CH to DY7-8CH, electron multiplier holes for the associated channel are formed.

The anodes 270, which correspond to the respective channels, are respectively fixed to the stem 230 and each of these anodes 270 is housed in the associated one of the through holes 260*a* of the protection electrodes 260.

Figure 4:
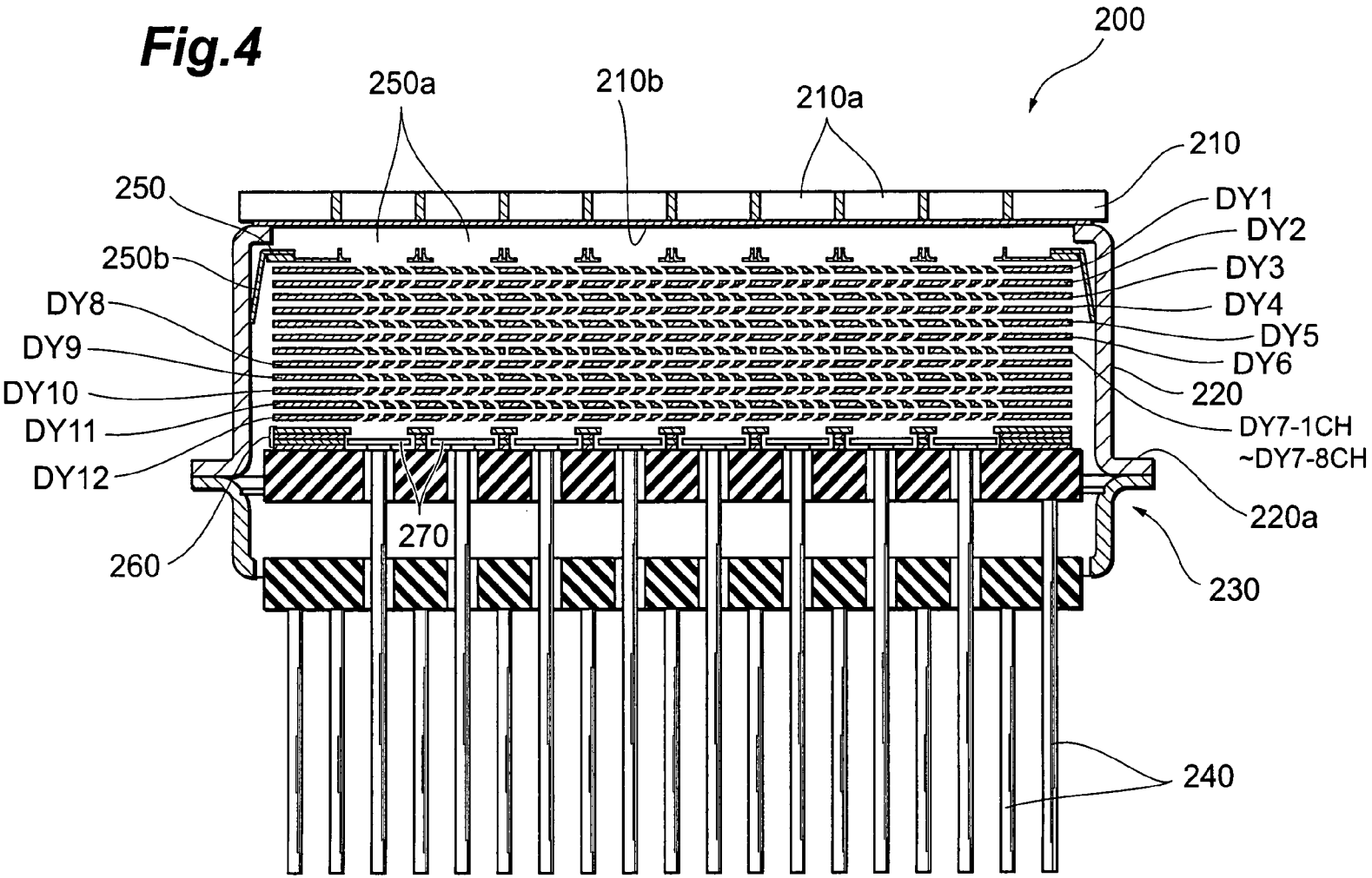
FIG. 4 shows a sectional view of the configuration of the photomultiplier according to the present invention taken along the line I—I in FIG. 1.

In the state that the dynode unit and the focusing electrode 250 have been installed successively on the protection electrode 260 as a base and with the ceramic spacers SP disposed in between, the photomultiplier 200, with the structure shown in FIG. 4, can be obtained by vacuuming inside of the sealed container constituted by the entrance face plate 210, the metal container 220, and the stem 230. FIG. 4 shows a sectional view of the structure of the photomultiplier 200 taken along line I—I of FIG. 1.

As shown in FIG. 4, the protection electrode 260 supports the entirety of the dynode unit via the ceramic spacers SP and has through holes 260*a*, which house the plurality of anodes 270 respectively and individually and reduce the electrical influences of the anodes 270 on each other. The focusing electrode 250, arranged between the photocathode 210*b* and the dynode unit, has the plurality of through holes 250*a* each corresponding to the associated one of the channels respectively assigned to the light incidence regions 210*a* partitioned on the entrance face plate 210. The photoelectrons, which are emitted from a region of the incidence surface place 210, by the actions of the focusing electrode 250, reach at a high probability to the electron multiplier hole, among the electron multiplier holes in the first dynode plate, which corresponds to the channel assigned to the region from which the photoelectrons are emitted. Crosstalk among the channels is thus reduced effectively.

Figure 5A:
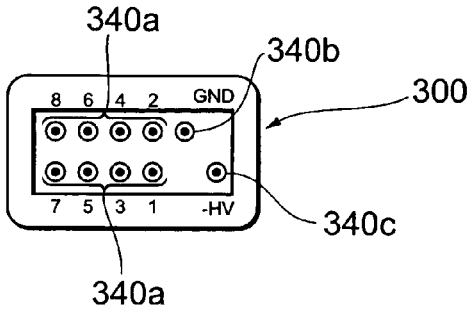
FIGS. 5A and 5B show a plan view and a circuit diagram, respectively, of a rear pin arrangement and a circuit arrangement of the bleeder circuit unit shown in FIG. 1.
Figure 5B:
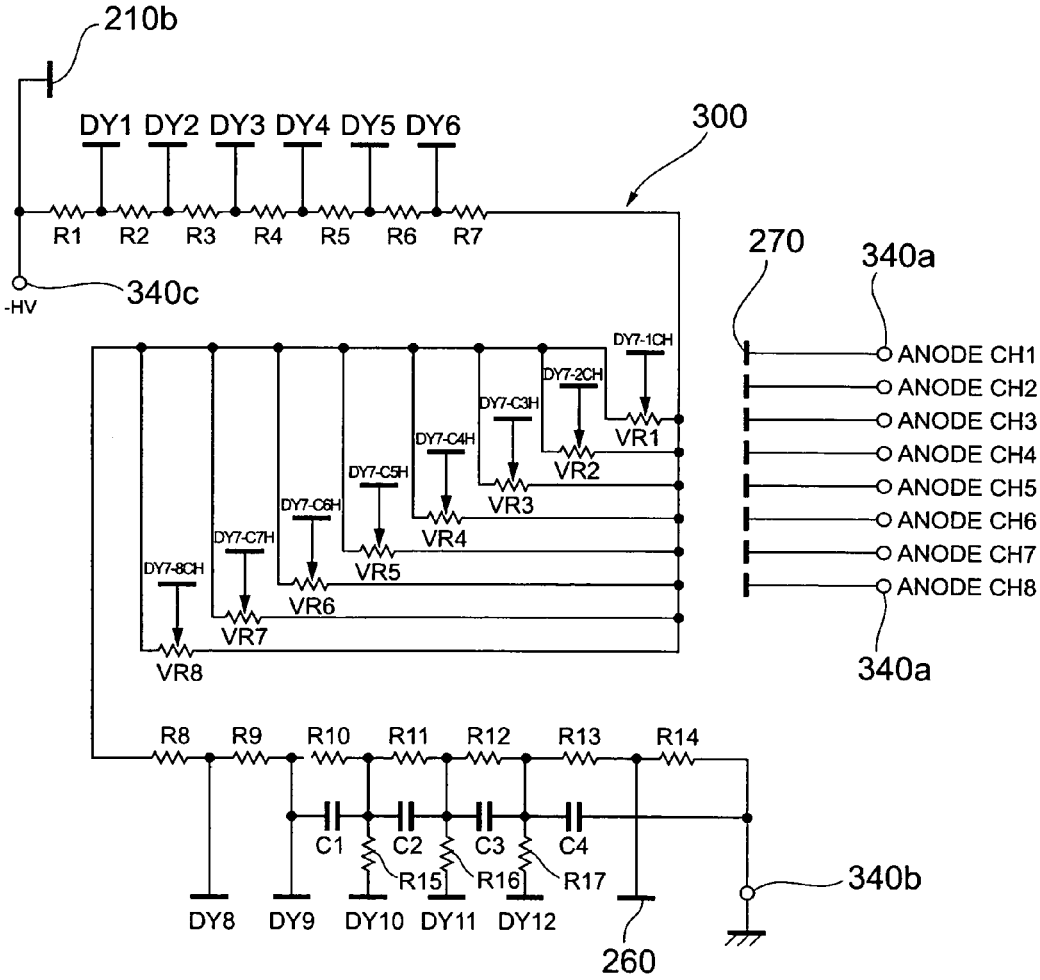

FIG. 5A shows a plan view of the rear pin arrangement of the bleeder circuit unit 300 and FIG. 5B shows a circuit diagram of the circuit arrangement of the bleeder circuit unit 300 shown in FIG. 1.

As shown in FIG. 5A, at the rear surface of the bleeder circuit unit 300, anode output terminals 340*a* for respectively taking out electrical signals from the plurality of anodes 270 positioned inside the sealed container of the photomultiplier 200, a ground terminal 340*b* for grounding the terminals at one side of the bleeder circuit in order to set dynode plates DY1 to DY12 of the respective stages constituting the dynode unit to predetermined potentials, and a terminal 340*c* for applying −HV to the terminals at the other side of the bleeder circuit are arranged.

The bleeder circuit, shown in FIG. 5B, is arranged inside the bleeder circuit unit 300, and in the seventh dynode plate, voltages, divided by variable resistors VR1 to VR8, are respectively applied to the control plates DY7-1CH to DY7-8CH that are electrically and physically separated from each other. Since the resistance values of variable resistors VR1 to VR8 can be changed by the adjusters 330, the gain adjustment for each channel is enabled by this adjusting mechanism.

Figure 6:
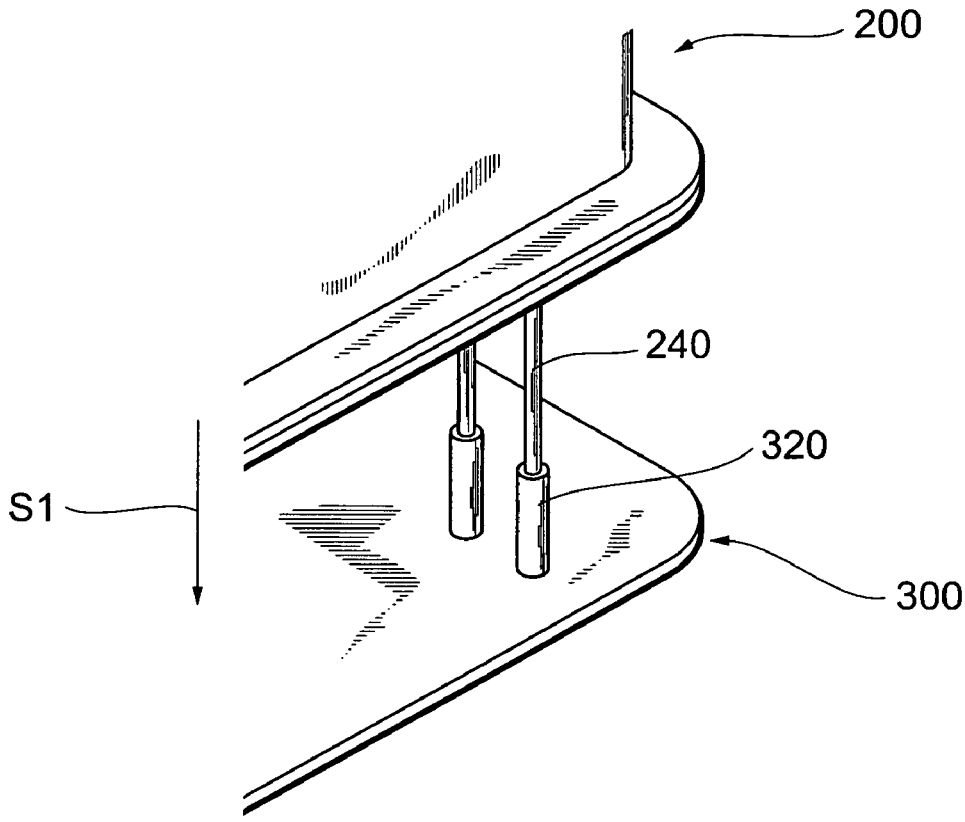
FIG. 6 shows a perspective view for explaining the connection structure between the photomultiplier and the bleeder circuit unit.

The fixing of the photomultiplier 200 to the bleeder circuit unit 300 is carried out as shown in FIG. 6. That is, the photomultiplier 200 is moved in the direction indicated by the arrow SI in this figure. By lead pins 240 becoming inserted into pipe-like metal sockets 320 of the bleeder circuit unit 300, and flange 220*a* of the metal container 220 of the photomultiplier 200 engaging with fixing members 310*a* and 310*b* in this process, the photomultiplier 200 becomes fixed to the bleeder circuit unit 300. FIG. 6 shows a perspective view for describing the structure for connecting the photomultiplier to the bleeder circuit unit.

Figure 7:
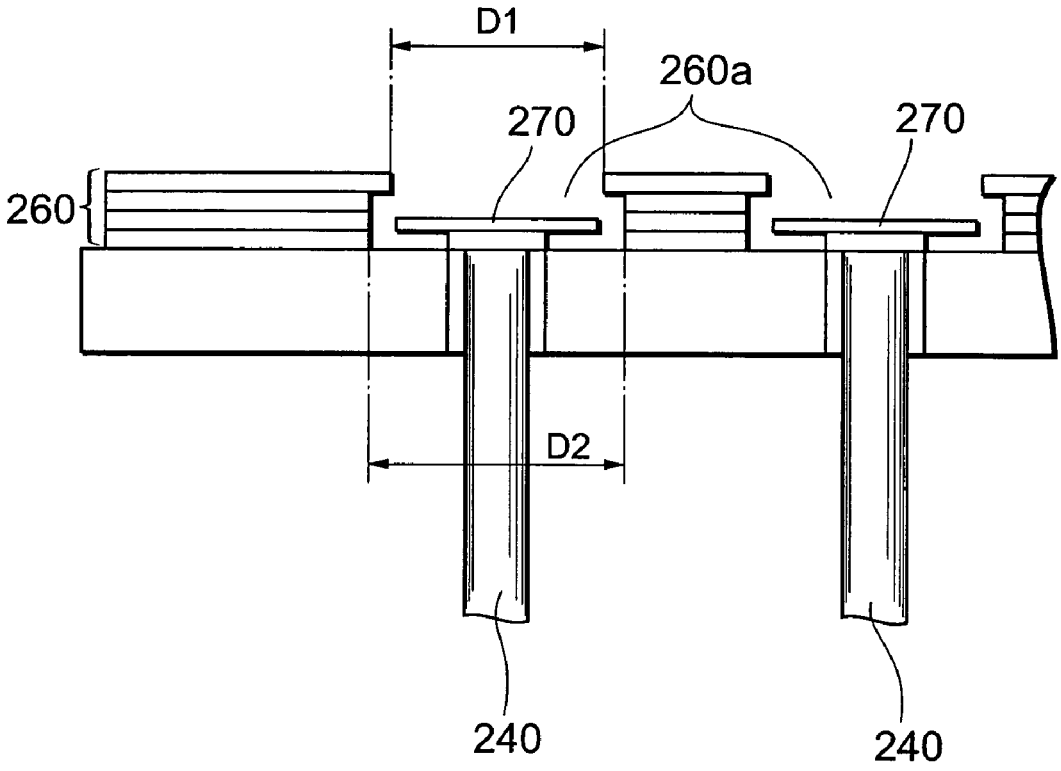
FIG. 7 shows a sectional view of a configuration of a protection electrode taken along the line II—II in FIG. 3.

In this embodiment, the positional relationship between the protection electrode 260 which supports the entirety of the dynode unit, and the anodes 270 which are prepared in correspondence with the respective channels, is set, for example, as shown in FIG. 7. FIG. 7 shows a sectional view of the structure of the protection electrode taken along line II—II of FIG. 3.

As shown in FIG. 7, the anodes 270, which are prepared in correspondence with the respective channels, are respectively housed in the through holes 260*a* of the protection electrode 260, and in the protection electrode 260, the opening diameters D1 at the dynode unit side are made narrower than the opening diameters D2 at the stem side. Since by this arrangement, the trajectories of the secondary electrons emitted from twelfth dynode plate DY12 (the final dynode plate) of the dynode unit towards the anodes 270 are converged every associated one of the anodes 270, crosstalk among anodes 270 corresponding to the respective channels is reduced effectively.

The arrangement of the respective dynode plates constituting the dynode unit shall now be described.

Figure 8A:
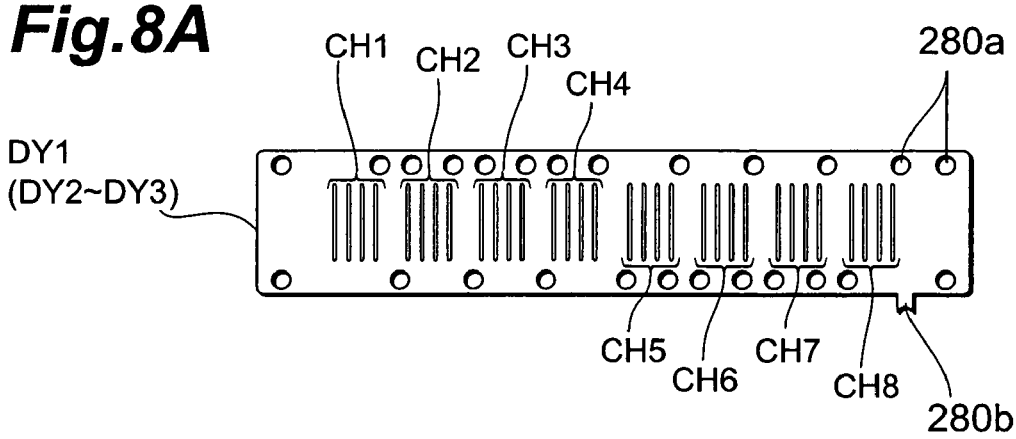
FIGS. 8A to 8C show diagrams for explaining a structure of a dynode plate of each stage.

First, FIG. 8A shows a plan view of the structure of first dynode plate DY1. As shown in FIG. 8A, first dynode plate DY1 has electron multiplier holes CH1 to CH8, respectively corresponding to the channels assigned to the plurality of the light incidence regions 210 partitioned on the entrance face plate 210. Here, CH1 indicates the electron multiplier holes for the first channel, CH2 indicates the electron multiplier holes for the second channel, CH3 indicates the electron multiplier holes for the third channel, CH4 indicates the electron multiplier holes for the fourth channel, CH5 indicates the electron multiplier holes for the fifth channel, CH6 indicates the electron multiplier holes for the sixth channel, CH7 indicates the electron multiplier holes for the seventh channel, and CH8 indicates the electron multiplier holes for the eighth channel. A secondary electron emission surface is formed at each electron multiplier hole.

The first dynode plate DY1 furthermore has through holes 280*a* which install the ceramic spacers Sp and are disposed at the peripheries of electron multiplier holes CH1 to CH8 for channels, and has a fixing member 280*b* which is fixed by welding to the lead pin 240 extending from the stem 230 for setting the first dynode plate DY1 to a predetermined potential. Though the first dynode plate DY1 is shown in FIG. 8A, the second and third dynode plates DY2 and DY3 have the same structure.

Figure 8B:
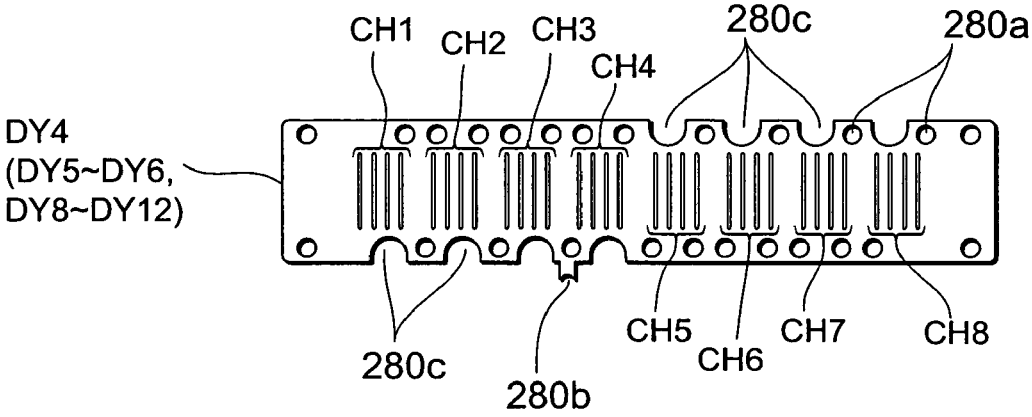

Meanwhile, as shown in FIG. 8B, the fourth dynode plate DY4 has, at its outer peripheral portions, a plurality of notch portions 280*c* with curved surfaces. FIG. 8B shows a plan view of the structure of fourth dynode plate DY4. In similar to the first dynode plate DY1, this fourth dynode plate DY4 has electron multiplier holes CH1 to CH8, respectively corresponding to the channels assigned to the plurality of the light incidence regions 210*a* partitioned on the entrance face plate 210. Here, CH1 indicates the electron multiplier holes for the first channel, CH2 indicates the electron multiplier holes for the second channel, CH3 indicates the electron multiplier holes for the third channel, CH4 indicates the electron multiplier holes for the fourth channel, CH5 indicates the electron multiplier holes for the fifth channel, CH6 indicates the electron multiplier holes for the sixth channel, CH7 indicates the electron multiplier holes for the seventh channel, and CH8 indicates the electron multiplier holes for the eighth channel. A secondary electron emission surface is formed at each electron multiplier hole.

The fourth dynode plate DY4 furthermore has through holes 280*a* which install the ceramic spacers SP and arranged at the peripheries of electron multiplier holes CH1 to CH8 for the respective channels, and has a fixing member 280*b* which is fixed by welding to the lead pin 240 extending from the stem 230 for setting the fourth dynode plate DY4 to a predetermined potential. Though the fourth dynode plate DY4 is shown in FIG. 8B, the fifth, sixth, and eighth to twelfth dynode plates DY5, DY6, and DY8 to DY12 have the same structure.

In particular, at the outer peripheral portions of each of these fourth to sixth and eighth to twelfth dynode plates DY4 to DY6 and DY8 to DY12, the plurality of notched portions 280*c* are provided in correspondence to the lead pins 240 respectively connected to the plurality of control plates DY7-1CH to DY7-8CH that constitute seventh dynode plate DY7, and are provided with curved surfaces so as to be separated from the lead pins 240 by a predetermined distance. This is because as the photomultiplier 200 is made compact, the distances between metal members, for example, the distances between a dynode plate DY and the lead pins 240 become close inevitably and the possibility of discharge being generated at the edge portions of these metal members becomes high. In the present embodiment, the lead pins 240, connected to control plates DY7-1CH to DY7-8CH must furthermore be introduced in a space in which a plurality of dynode plates are integrated. Thus with this embodiment, by intentionally processing the outer peripheral portions of the fourth dynode plate DY4 to shapes having curved surfaces, the generation of discharge is restrained.

Figure 8C:
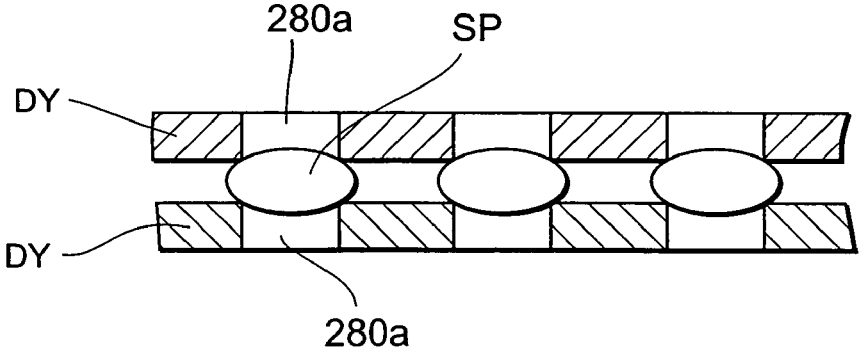

The dynode plates with the above structure are respectively laminated with the ceramic spacers SP arranged in between as shown in FIG. 8C. That is, by installing the ceramic spacers SP at positions of the through holes 280*a* of a lower dynode plate and then installing an upper dynode plate so that its through holes 280*a* overlap with the ceramic spacers SP, a dynode unit, in which a plurality of dynode plates are laminated, is obtained.

Figure 9A:
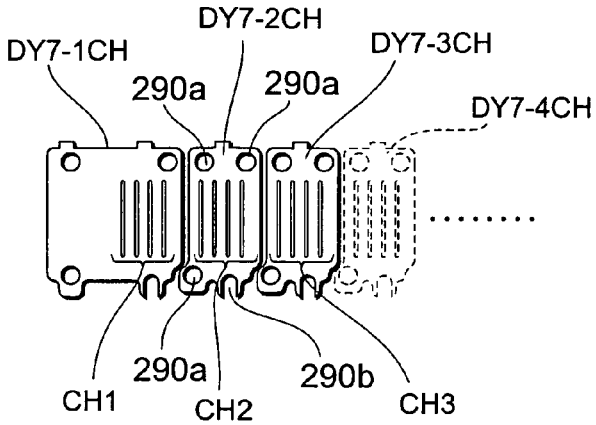
FIGS. 9A and 9B show diagrams for explaining a structure of each of control plates which are provided in each channel and are sandwiched by the dynode plates shown in FIG. 8.

However, in the photomultiplier according to the present invention, the structure of the seventh dynode differs. That is, as shown in FIG. 9A, this seventh dynode plate is constituted by the control plate DY7-1CH having the electron multiplier holes CH1 for the first channel, the control plate DY7-2CH having the electron multiplier holes CH2 for the second channel, the control plate DY7-3CH having the electron multiplier holes CH3 for the third channel, the control plate DY7-4CH having the electron multiplier holes CH4 for the fourth channel, the control plate DY7-5CH having electron multiplier holes CH5 for the fifth channel, the control plate DY7-6CH having the electron multiplier holes CH6 for the sixth channel, the control plate DY7-7CH having the electron multiplier holes CH7 for the seventh channel, and the control plate DY7-8CH having the electron multiplier holes CH8 for the eighth channel. For example, the control plate DY7-2CH is provided with through holes 290*a* for setting the ceramic spacers SP for maintaining a state of insulation between the dynode plates DY6 and DY8 that are positioned above and below, and with a fixing member 290*b* that is fixed by welding by solder to the lead pin 240. The other control plates DY7-1CH and DY7-3CH to DY7-8CH have the same structure.

Figure 9B:
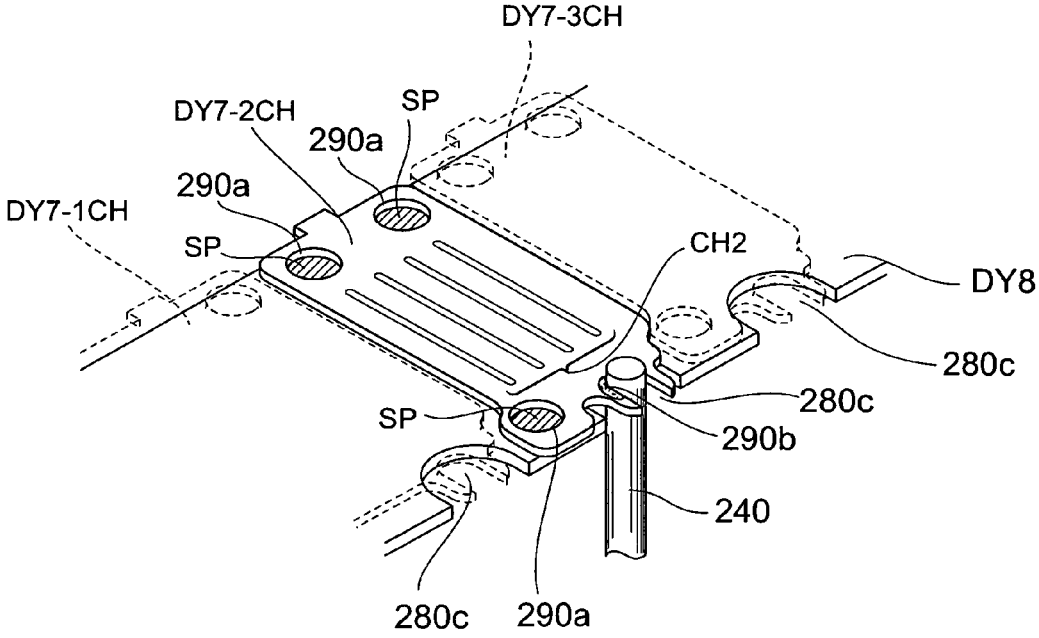

As shown in FIG. 9B, the control plate DY7-2CH with the above-described structure is supported by three ceramic spacers SP disposed between the control plate DY7-2CH and the eighth dynode plate DY8, and by the lead pin 240 extending from the stem 230. Also by the sixth dynode DY6 being installed above the control plate DY7-2CH via the ceramic spacers SP, the control plates DY7-1CH to DY7-8CH that make up the seventh dynode plate DY7 are sandwiched, in the state of being separated from each other electrically and physically, between the sixth and eighth dynode plates DY6 and DY8. By this arrangement, each of the control plates DY7-1CH to DY7-8CH that make up the seventh dynode plate can be set to an arbitrary potential, and the gain adjustment for each channel can be realized by a more compact structure. In addition, since extraneous structures can be eliminated, the entirety of the photomultiplier 200 can be made even more compact.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier, comprising:

a sealed container having an entrance face plate partitioned into a plurality of light incidence regions, and a stem opposing said entrance face plate;

a photocathode emitting photoelectrons into said sealed container in response to light having passed through said entrance face plate;

a plurality of anodes respectively prepared for electron multiplier channels which are assigned to said light incidence regions partitioned on said entrance face plate, and being respectively positioned inside said sealed container so as to oppose said associated light incidence regions; and a dynode unit housed in said sealed container, disposed between said anodes and said photocathode, and constituted by N (an integer of no less than 3) dynode plates, each of said dynode plates being provided with an electron multiplier hole for the associated channel, concerning all channels, and being arranged at a position corresponding to the associated one of said plurality of light incidence regions, wherein a n-th (an integer of no less than 2) dynode plate in said dynode unit is constituted by a plurality of control plates each having an electron multiplier hole for the associated channel and being electrically and physically separated from the others, and wherein said control plates are supported in a state of being sandwiched, via insulators, by a (n−1)-th dynode plate and a (n+1)-th dynode plate.

2. A photomultiplier according to claim 1, further comprising a protection electrode provided between said stem and said dynode unit, and having a plurality of through holes each individually housing the associated one of said anodes.

3. A photomultiplier according to claim 2, wherein a diameter of each dynode side opening of said protection electrode is narrower than a diameter of each stem side opening of said protection electrode.

4. A photomultiplier according to claim 1, wherein each of said control plates constituting said n-th dynode plate is supported by at least three insulators provided between said n-th dynode plate and said (n+1)-th dynode plate, and by one lead pin extending into said sealed container through said stem.

5. A photomultiplier according to claim 4, wherein, among said dynode plates constituting said dynode unit, each of at least dynode plates positioned between said n-th dynode plate and said plurality of anodes has, at outer peripheral portions thereof, a plurality of notched portions each provided in correspondence to the associated one of said lead pins respectively connected to said plurality of control plates constituting said n-th dynode plate, and having a curved surface so as to be separated from the associated lead pin by a predetermined distance.

6. A photomultiplier according to claim 1, further comprising a focusing electrode provided between said photocathode and said dynode unit, and having a plurality of through holes each arranged at a position corresponding to the associated one of said light incidence regions.

7. A photodetector, comprising:

a photomultiplier according to claim 1; and a bleeder circuit unit for setting at least each of said dynode plates constituting said dynode unit in said photomultiplier to predetermined potentials.

8. A photodetector according to claim 7, wherein said bleeder circuit unit has an adjusting mechanism for setting each of said control plates constituting said n-th dynode plate, among said N dynode plates constituting said dynode unit, to an arbitrary potential individually.

9. A photodetector according to claim 7, further comprising a case housing said photomultiplier and said bleeder circuit unit while leaving exposed at least part of said entrance face plate of said photomultiplier.

10. A photodetector according to claim 9, wherein said bleeder circuit unit has an adjusting mechanism for setting each of said control plates constituting said n-th dynode plate, among said N dynode plates constituting said dynode unit, to an arbitrary potential individually, and wherein said case has an opening for adjusting, from an exterior of said case, said adjusting mechanism provided in said bleeder circuit unit.

* * * * *